US006267055B1

(12) United States Patent
Fromson et al.

(10) Patent No.: US 6,267,055 B1
(45) Date of Patent: Jul. 31, 2001

(54) DUAL LASER THERMAL IMAGING

(75) Inventors: Howard A. Fromson, 43 Main St., Stonington, CT (US) 06378; William J. Rozell, Vernon, CT (US)

(73) Assignee: Howard A. Fromson, Stonington, CT (US)

( * ) Notice: Subject to any disclaimer, the term of this patent is extended or adjusted under 35 U.S.C. 154(b) by 0 days.

(21) Appl. No.: 09/618,338

(22) Filed: Jul. 18, 2000

(51) Int. Cl.[7] ..... B41C 1/10
(52) U.S. Cl. ..... 101/467; 101/457; 430/303
(58) Field of Search ..... 101/457, 459, 101/462, 463.1, 465, 466, 467, 401.1; 430/300, 302, 303, 306, 307, 945, 346

(56) References Cited

U.S. PATENT DOCUMENTS 3,619,157 * 11/1971 Brinckman ..... 101/467
3,642,475 * 2/1972 Vrancken et al. ..... 101/467
4,064,205 * 12/1977 Landsman ..... 101/467
4,383,261 * 5/1983 Goldberg ..... 347/224
5,747,217 * 5/1998 Zaklika et al. ..... 430/302
5,804,355 * 9/1998 Bosschaerts et al. ..... 430/346
5,932,394 * 8/1999 Van Hunsel et al. ..... 430/302
5,950,542 * 9/1999 Harris et al. ..... 101/467

* cited by examiner

*Primary Examiner*—Stephen R. Funk
(74) *Attorney, Agent, or Firm*—Alix, Yale & Ristas, LLP

(57) ABSTRACT

A positive-working lithographic printing plate which is imageable by dual infrared lasers has a substrate which absorbs modulated, imaging infrared laser radiation of one wavelength to heat the substrate and an adjacent coating. The substrate has a coating which is a material which will react and form gaseous reaction products which ablate or propel the coating from the substrate upon reaching a threshold reaction temperature. The coating is transparent to the infrared radiation of the one wavelength and contains a dye which absorbs unmodulated, non-imaging infrared laser radiation of another wavelength to heat the coating. The unmodulated, non-imaging infrared laser radiation heats the coating in the imaged areas to a temperature below the threshold temperature and the heat from the substrate further heats the coating to a temperature above the threshold temperature and ablates the coating in the imaged areas.

20 Claims, No Drawings

DUAL LASER THERMAL IMAGING

BACKGROUND OF THE INVENTION

The present invention relates to the imaging of a plate having a coating imageable by infrared radiation and more specifically to infrared imaging with simultaneous supplemental infrared heating to improve the imaging process. The invention is particularly directed to the imaging of lithographic printing plates.

Positive-working lithographic printing plates or other imageable plates which have a coating selectively removed from the plate by exposure to imaging infrared laser radiation are known in the prior art. One category of these plates has a coating on a substrate wherein the coating is transparent to the imaging infrared radiation and wherein the substrate absorbs the infrared radiation generating heat. The generated heat then removes the coating in the imaged areas by ablation or combustion of the coating. International Patent Application Publication No. WO 98/52743, published Nov. 26, 1998 and the related U.S. patent application Ser. No. 09/079,735, filed May 15, 1998, now U.S. Pat. No. 6,145,565, discloses a laser imageable printing plate having a coating which is transparent to the laser imaging radiation and having a substrate which absorbs the radiation. In that patent application, the coating is ablated from the substrate by the heat generated as a result of the substrate absorbing the radiation. The ablation is a function of the heat disrupting the physical bond between the substrate and the coating and pulverizing the coating probably by expansion of the substrate beneath the relatively brittle coating. Another known type of a coating which can be removed by heating the substrate with the infrared laser radiation is a coating which will undergo a thermally induced chemical reaction such as combustion. In either case, certain minimum laser power levels and exposure times are required to produce the heating required.

SUMMARY OF THE INVENTION

An object of the present invention is to provide an improved method of infrared laser imaging an imageable plate having a substrate with a coating which is removed in the imaged areas by a chemical reaction initiated by heat from the infrared radiation. The chemical reaction is a reaction which rapidly produces gaseous reaction products which blow or propel the coating off the substrate in the imaged areas. The heating is effected by dual lasers with one laser being a modulated imaging laser of a selected wavelength and the other being an unmodulated, non-imaging laser of a different wavelength. The coating is transparent to the modulated imaging laser radiation with this radiation being absorbed by the substrate and thereby heating the substrate and the adjacent coating. The coating contains an absorber for the unmodulated, non-imaging laser radiation whereby this radiation directly supplies supplemental heat to the coating. The supplemental heating is limited to a temperature below the threshold reaction temperature of the coating and the heating from the imaging radiation is sufficient to take the coating temperature over that threshold. The advantage of the invention is that the power needed for the modulated imaging infrared laser is reduced.

DESCRIPTION OF THE PREFERRED EMBODIMENTS

The present invention will be described in detail with respect to lithographic printing plates but it is to be recognized that the invention is also applicable to the imaging of other articles such as printed circuit boards.

The lithographic printing plate of the invention is imaged by dual lasers with one laser being a modulated, imaging infrared laser of a selected wavelength and the other being an unmodulated, non-imaging infrared laser of a different wavelength. The plate comprises a substrate with a coating which is removed as a result of a localized chemical reaction of the coating caused by the heating of the coating in those areas where the printing plate has been imaged or written by the imaging laser. The chemical reaction is one which rapidly releases gaseous reaction products that essentially blow the coating off the plate in the imaged areas as will be more fully explained later. More specifically, the coating has a threshold reaction temperature with a portion of the necessary heat being supplied directly by the unmodulated, non-imaging infrared laser and the other portion being supplied indirectly as a result of the heating of the substrate by the modulated, imaging infrared laser.

The substrate of the present invention is metal which is preferably aluminum but which also could be other metals such as titanium, tin, zinc, lead, iron, steel and alloys thereof. Laminates of metals can also be used. The substrate is adapted to absorb the infrared radiation and thereby heat the substrate and transfer heat to the adjacent, overlying coating. Specifically, the substrate is adapted to absorb the modulated, imaging infrared radiation of the selected wavelength in the imaged areas and thereby generate localized heat in those areas of the substrate and transfer that heat to the coating. For example, the substrate may be rotary brush grained, which is a known procedure for graining lithographic printing plates, to the degree required to impart the ability of the substrate to absorb the infrared radiation. While not being bound by any particular theory, it appears that rotary brush graining to the extent needed to embed particles during the graining process gives rise to a unique character of the substrate surface. The particles have a low thermal conductivity relative to the metal. These embedded particles within the metal matrix make for a very circuitous and thus less efficient path for heat dissipation. The energy captured at the surface cannot be transferred efficiently to the body of the substrate via the thin cross sections by which thermal continuity to the body of the substrate metal sheet is maintained. This results in a temperature rise at the surface of the grained metal sheet. While this rotary brush graining has been shown to be an efficient method for producing these surfaces, the present invention is applicable to any substrate which absorbs the radiation and sufficiently heats the substrate and coating. The substrate may also be anodized to have the hardness and durability attributable to the anodizing as is desirable for printing. An anodic oxide thickness of about one micron or less, preferably about 0.5 microns, is most suitable.

The preferred substrate utilized in the present invention is as taught in the aforementioned International Patent Application No. WO/98/52743 and related U.S. patent application Ser. No. 09/079,735, now U.S. Pat. No. 6,145,565. It is an effective absorber of infrared radiation at the surface and the construction tends to inhibit energy losses to the heat sink of the bulk substrate in the time frame of the imaging process thereby heating the surface. This is an important property since the source of a portion of the energy that brings the coating above its threshold reaction temperature is the heat transferred to it from the substrate surface. This substrate is also known to have excellent properties as the non-printing surface when used as a conventional lithographic printing plate.

The coating on the substrate is a coating which will be removed from the substrate in the imaged areas as a result of the heating of the coating. The coating is transparent to the modulated, infrared imaging radiation of the selected wavelength which causes the heating of the substrate and the adjacent coating thereby providing a portion of the heat needed to reach the threshold temperature. The additional heat necessary to remove the coating is supplied by another laser which is unmodulated and operates at an infrared wavelength different from the modulated, imaging laser. This other, unmodulated laser heats the coating by virtue of the coating containing an infrared radiation absorbing dye which is selected to absorb the wavelength of this other laser and to be transparent to the wavelength of the imaging laser. As with the imaging laser, the other laser is operated at a power level insufficient to heat the coating to the threshold reaction temperature. The operating power of this other, non-imaging laser is selected to heat the coating to a point approaching but below the threshold coating reaction temperature. The imaging laser then only needs to supply a small amount of additional heat.

The coating of the present invention is an energetic polymer which in terms of the present invention means that it will chemically react when heated above a threshold temperature. The chemical reaction may either be a self oxidizing combustion reaction or an explosive gas-generating reaction. In either case, the gaseous products of the reaction propel the coating from the substrate. Nitrocellulose is an example of a polymer coating which will undergo a self oxidizing combustion reaction and generate gaseous combustion products when heated to a threshold combustion temperature. This is generally in excess of about 279° F. which is the autoignition point for some nitrocellulose films. The combustion of the coating leaves only a fine dust or residue which is readily removed. The rapid combustion actually blows or blasts the coating from the plate. Polymer coatings which will produce nitrogen gas when heated above a threshold temperature are an example of coating which undergo an explosive gas-generating reaction. These include glycidyl azide polymers, bis (azidomethyl) oxetane polymers and azidomethyl methyloxetane polymers. Once again, the imaged coating is actually blown or blasted away. In either case, no development is required as with a plate where the coating is merely solubilized. A vacuum device may optionally be used to remove the residue from the surface. For further details of such coating materials, see U.S. Pat. No. 5,278,023 and the publication entitled, "Effects of Energetic Polymers on Laser Photothermal Imaging Materials"; S. G. Koulikov and Dana D. Dlott; Journal of Imaging Science and Technology; Volume 44, Number 2, March/April 2000.

The coating should be as thin as possible but still adequately cover the substrate to provide a durable image for printing. Coating weights in the range of about 50 to about 500 milligrams per square foot can be used, but it is preferable to work in the range of about 100 to 200 milligrams per square foot. Thicker coatings require more time and energy to remove. Reducing the coating weight from 200 milligrams per square foot to 150 milligrams per square foot can result in a reduction in laser exposure time of about 15%.

Although the invention is not limited to any particular combination of laser wavelengths, a specific example is a modulated, imaging laser which is a YAG infrared laser operating at 1064 nanometers and an unmodulated, non-imaging laser which is a diode infrared laser operating at 830 nanometers. In this case, the coating will contain an absorber material or dye which substantially absorbs the 830 nm infrared radiation and which is substantially transparent to the 1064 nm infrared radiation. Examples of such dyes are squarylium, croconate, cyanine, phthalocyanine, merocyanine, chalcogenopyryloarylidene, orzindollizine, puinoid, indolizine, pyrylium, thizine, azulenium and xanthene dyes. Although this example relates to an imaging 1064 nm laser and a non-imaging 830 nm laser, the invention may be operated with any combination of laser wavelengths as long as the imaging laser heats the substrate and the non-imaging laser heats the coating directly and the coating contains a dye which is transparent to the imaging wavelength and absorptive of the non-imaging wavelength.

In order to image with the dual lasers of the present invention, the spots on the plate from the two lasers must be superimposed. To facilitate this superimposition and taking into consideration the ability to aim and focus the lasers, one laser spot is larger than the other with the small spot being within the bounds of the larger spot. This assures that there is adequate imaging heat and avoids any problems from improper alignment of two small spots. Since this imaging process is a threshold process and not progressive, the image modulated spot could either be the smaller or the larger spot.

The energetic coating may have an overcoat or top coat of certain resins, such as phenolic polymers or silicone resins which would serve to form an improved printing surface. These resins will be ablated along with the energetic coating in the imaged areas. Phenolic resins which are useful, such as novolac or resole resins, are described in Chapter XV of "Synthetic Resins in Coatings," H. P. Preuss, Noyes Development Corporation (1965), Pearl River, N.Y. Phenylmethylsiloxane is an example of a useful silicone resin. However, other ablatable coatings can be used and determined empirically. The infrared absorbing dye is not included in the overcoat, only in the energetic polymer layer. The embodiment in which the combustible coating is used as a subcoating to ablate an overlying top coating is also suited to the preparation of a dryographic printing plate. The top coating for the dryographic plate would be a low surface energy coating such as a silicone coating.

In the prior art, all of the heat is supplied by a single laser such as a YAG infrared laser operating at 1064 nm and at power levels as high as 15 watts. In the present invention, the modulated, imaging laser is a lower power laser which cannot by itself heat the substrate and coating to the degree necessary to remove the coating. The advantage of the present invention is that a smaller, less powerful, less expensive laser can be used as the imaging laser with a smaller, less expensive modulator.

What is claimed is:

1. A method of imaging a coating on a substrate with first and second infrared lasers operating at first and second wavelengths respectively, said coating being transparent to infrared radiation of said second wavelength and being reactive at temperatures in excess of a reaction threshold temperature to yield gaseous reaction products, said method comprising the steps of operating said first laser at said first wavelength in an unmodulated mode causing said coating to be heated just below said reaction threshold temperature and operating said second laser at said second wavelength in an imaged modulated mode and thereby selectively heating said substrate and causing said coating to be selectively further heated to exceed said reaction threshold temperature and chemically react to yield said gaseous reaction products and causing said coating to be selectively propelled from the surface of said substrate.

2. A method as recited in claim 1 wherein said coating is absorptive of infrared radiation of said first wavelength.

3. A method as recited in claim 1 wherein said coating is a combustible coating.

4. A method as recited in claim 3 wherein said coating contains nitrocellulose.

5. A method as recited in claim 1 wherein said coating produces nitrogen gas.

6. A method as recited in claim 1 wherein said first wavelength is 830 nm and said second wavelength is 1064 nm.

7. A method as recited in claim 1 and further including a top coat over said coating wherein said top coat contains no infrared radiation absorptive dye.

8. A method as recited in claim 7 wherein said top coat is selected from phenolic polymers and silicone resins.

9. A method of imaging a coating on a substrate with two infrared lasers wherein a first laser operates at a first wavelength in an unmodulated mode and a second laser operates at a second wavelength in an image modulated mode and wherein said coating is absorptive of said first wavelength and transparent to said second wavelength and wherein said coating chemically reacts when heated to a temperature in excess of a reaction threshold temperature and yields gaseous reaction products that cause said coating to be selectively propelled from said substrate, said method comprising the steps of:

a. focusing a controlled level of radiation from said unmodulated first laser onto an area of said coating whereby said unmodulated infrared laser radiation is absorbed by and heats said coating and whereby said controlled level of radiation from said unmodulated first laser heats said coating to a temperature below said reaction threshold temperature; and b. focusing radiation from said modulated second laser onto said area of said coating whereby said modulated infrared laser radiation is absorbed by and selectively heats said substrate thereby causing said coating to be selectively further heated to a temperature exceeding said reaction threshold temperature and causing said coating to chemically react to yield said gaseous reaction products and selectively propel said coating from said substrate.

10. A method as recited in claim 9 wherein said coating is a combustible coating.

11. A method as recited in claim 10 wherein said coating contains nitrocellulose.

12. A method as recited in claim 9 wherein said coating produces nitrogen gas.

13. A method as recited in claim 9 wherein said first wavelength is 830 nm and said second wavelength is 1064 nm.

14. A method as recited in claim 9 and further including a top coat over said coating wherein said top coat contains no infrared radiation absorptive dye.

15. A method as recited in claim 14 wherein said top coat is selected from phenolic polymers and silicone resins.

16. A positive-working lithographic printing plate comprising a coating on a substrate, said coating comprising a material which reacts upon reaching a threshold reaction temperature to produce a gas which propels said coating from said substrate, said coating being absorptive of infrared radiation of a first wavelength and being transparent to infrared radiation of a second wavelength and said substrate being absorptive of and heated by infrared radiation of said second wavelength.

17. A positive-working lithographic printing plate as recited in claim 16 wherein said coating is a combustible coating.

18. A positive-working lithographic printing plate as recited in claim wherein said combustible coating contains nitrocellulose.

19. A positive-working lithographic printing plate as recited in claim wherein said coating produces nitrogen gas.

20. A positive-working lithographic printing plate as recited in claim 16 wherein said coating is absorptive of 830 nm infrared radiation and transparent to 1064 nm infrared radiation.

* * * * *

UNITED STATES PATENT AND TRADEMARK OFFICE

CERTIFICATE OF CORRECTION

PATENT NO. : 6,267,055 B1
DATED : July 31, 2001
INVENTOR(S) : Fromson et al.

It is certified that error appears in the above-identified patent and that said Letters Patent is hereby corrected as shown below:

Column 6,
Line 21, before “bolt” insert -- trigger --.
Line 29, after “claim” insert -- 17 --.
Line 32, after “claim” insert -- 16 --.

Signed and Sealed this

Twenty-fourth Day of December, 2002

JAMES E. ROGAN
*Director of the United States Patent and Trademark Office*